US005146199A

United States Patent [19]

Schneider et al.

[11] Patent Number: 5,146,199

[45] Date of Patent: Sep. 8, 1992

[54] CIRCUIT BREAKER HAVING CRIMPED METAL COVER

[75] Inventors: John L. Schneider, N. Waterboro; Timothy R. Walker, Poland, both of Me.

[73] Assignee: GTE Products Corporation, Stamford, Conn.

[21] Appl. No.: 822,222

[22] Filed: Jan. 17, 1992

[51] Int. Cl.[5] ..... H01H 37/04; H01H 37/52

[52] U.S. Cl. ..... 337/380; 337/112; 337/372

[58] Field of Search ..... 337/380, 381, 112, 113, 337/372; 174/52.5; 200/83.9, 293, 302.1

[56] References Cited

U.S. PATENT DOCUMENTS

| | | | |
|---|---|---|---|
| 4,410,776 | 10/1983 | Stoll | 200/83 P |
| 4,902,999 | 2/1990 | Ball, Jr. et al. | 337/372 |
| 5,014,035 | 5/1991 | Hamada et al. | 337/372 |

*Primary Examiner*—Harold Broome

*Attorney, Agent, or Firm*—James Theodosopoulos

[57] ABSTRACT

An electrical circuit breaker has an insulative rigid base on which a circuit breaker assembly is mounted. The base has two long sides with grooves extending the full lengths thereof. A metal cover is crimped onto the base at and along the full lengths of the grooves.

4 Claims, 2 Drawing Sheets

CIRCUIT BREAKER HAVING CRIMPED METAL COVER

BACKGROUND OF THE INVENTION

This invention concerns electrical circuit breakers of the bimetal type such as are disclosed in U.S. Pat. No(s). 4,902,999 and 4,924,202. The invention particularly concerns such circuit breakers as are enclosed in a metal or plastic cover.

SUMMARY OF THE INVENTION

It occasionally happens that the contacts of the circuit breaker weld together, resulting in catastrophic failure with rapid emission of sparks and molten metal fragments along with radiant heat generation. Plastic covers are inadequate to retain the sparks and molten fragments as well as to resist the radiant heat. Present metal covers, which are only spot crimped, allow sparks and molten fragments to escape. This invention discloses a metal cover which can contain such sparks and molten fragments.

A circuit breaker in accordance with this invention has an insulative rigid base on which the circuit breaker elements are mounted. The insulative rigid base has narrow grooves extending the full length of both long sides of the base. An elongate metal cover fits over the base and is secured thereto by crimping the metal cover at and along the full lengths of the narrow grooves of the base. That is to say, a narrow strip of metal on each long side of the metal cover is crimped so as to be forced into the narrow groove on the base.

Figure 1:
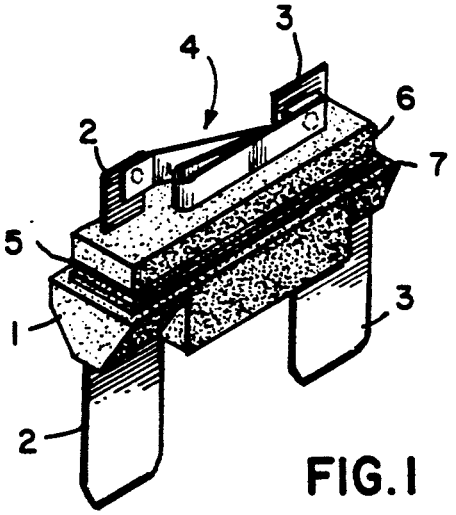
FIG. 1 is an isometric view and FIG. 2 is an elevational view of a circuit breaker in accordance with this invention but without the cover.
Figure 2:
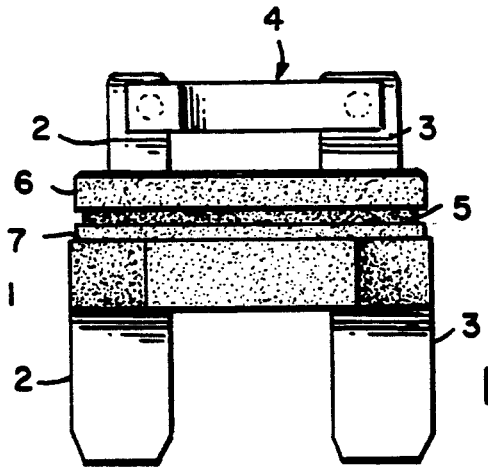
Figure 3:
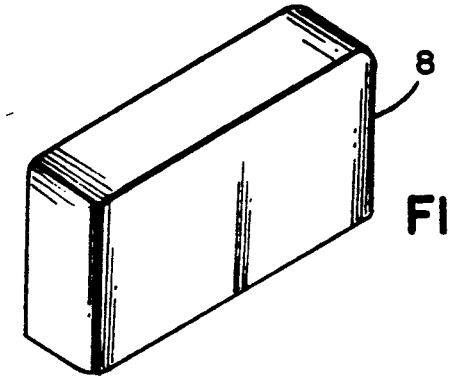
FIG. 3 shows the metal cover.
Figure 4:
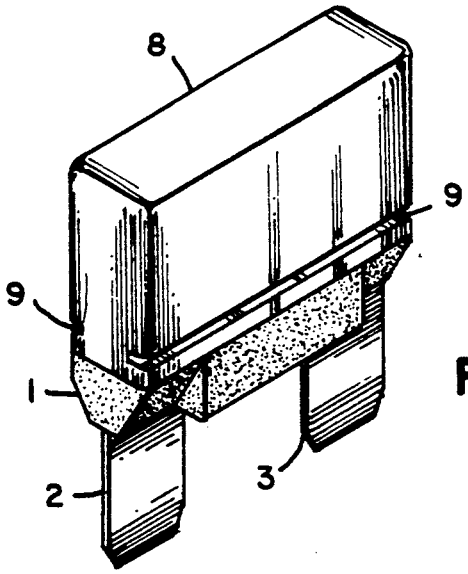
FIGS. 4, 5 and 6 are, respectively, isometric elevational and end views of the enclosed circuit breaker.
Figure 5:
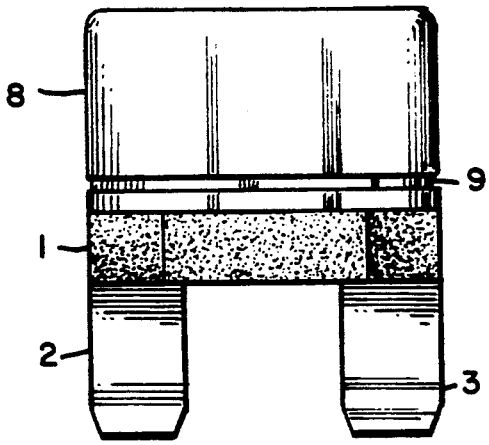
Figure 6:
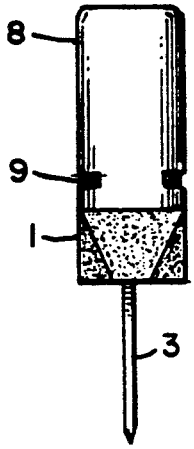

As shown in FIGS. 1 and 2, one example of a circuit breaker in accordance with this invention, comprises an elongated insulative base 1 made, for example, of rigid plastic, having terminals 2 and 3 protruding externally and internally therefrom. Supported on the internal portions of terminals 2 and 3 is a bimetal circuit breaker assembly 4 such as is disclosed in U.S. Pat. No. 4,902,999, the disclosure of which is incorporated herein by reference. There are narrow shallow grooves 5 on all four sides of substantially rectangular upper portion 6 of base 1. Base 1 has a landed surface 7 slightly below grooves, 5. Metal cover 8, shown in FIG. 3, is a slip fit over rectangular portion 6 and, upon assembly, rests against landed surface 7 and is then crimped onto plastic base 1. The crimping is such that a narrow strip 9 on each long side of metal cover 8 is forced into groove 5, thereby securing cover 8 to base 1. Some crimping also occurs on the shorter sides of cover 8.

We claim:

1. A circuit breaker comprising: an insulative rigid base having two terminals protruding externally and internally therefrom, the base having two long sides with narrow grooves extending the full lengths of the long sides; a bimetal circuit breaker assembly supported on the internal portions of the two terminals; and a metal cover enclosing the circuit breaker assembly, the metal cover being crimped to the two long sides of the base at and along the full lengths of the narrow grooves.

2. The circuit breaker of claim 1 wherein the upper portion of the base is substantially rectangular and wherein the metal cover is a slip fit on said rectangular portion.

3. The circuit breaker of claim 1 wherein the cover has two long sides and two short sides and wherein the crimping extends completely along the long sides and onto the short sides.

4. The circuit breaker of claim 1 wherein the base has a landed surface slightly below the narrow grooves and wherein the metal cover rests against the landed surface at the time of crimping.

* * * * *